United States Patent [19]

Moore

[11] 4,106,114

[45] Aug. 8, 1978

[54] INCLINED CONICAL ROTARY VESSELS FOR STORAGE AND TUMBLING OF MATERIALS TO ACCOMPLISH MIXING AND HEAT TRANSFER

[76] Inventor: James E. Moore, 1401 Meadow La., Glenview, Ill. 60025

[21] Appl. No.: 788,638

[22] Filed: Apr. 18, 1977

[51] Int. Cl.[2] ..... B01F 15/02; B01F 15/06; B01F 9/02

[52] U.S. Cl. ..... 366/131; 366/135; 366/144; 366/153; 366/167; 366/186; 366/607; 432/105

[58] Field of Search ..... 259/3, 14, 15, 16, 31, 259/32, 33, 57, 58, 81 R, 89, 156, 157, 158; 432/105, 118; 34/134, 140, 141, 108

[56] References Cited

U.S. PATENT DOCUMENTS

| | | | |
|---|---|---|---|
| 3,434,697 | 3/1969 | Carlson | 259/3 |
| 3,471,267 | 10/1969 | Capes | 259/3 |
| 3,606,860 | 9/1971 | Dunn | 259/3 |
| 3,751,820 | 8/1973 | Brilloit | 259/3 |
| 3,812,821 | 5/1974 | Laycock | 259/3 |
| 3,939,783 | 2/1976 | Chambon | 432/105 |

*Primary Examiner*—Robert W. Jenkins
*Attorney, Agent, or Firm*—Leydig, Voit, Osann, Mayer & Holt, Ltd.

[57] ABSTRACT

A tumbler assembly for mixing, storing and feeding particulate materials and for transferring heat between different materials which includes a tumbler having a lower portion in the form of a hollow inverted lower cone enclosed by a circular cover. The cover has an axial inlet and the cone has an axial outlet. The tumbler is rotatably supported with its axis inclined at an angle of 30° to 75° with respect to the horizontal, the tumbler having driving means for rotating the same at a speed within the range of a fraction of a revolution per minute up to several revolutions per minute. The cone has an included angle within the range of 80° to 135°. The outlet is restricted to control the rate of flow so that a body of material is maintained in the tumbler, the material being constantly mixed by cascading of material across the surface of the body and movement of material within the body as the material is withdrawn along a multiplicity of paths which, by reason of the conical shape and inclined axis, precess orbitally through the mass. In an alternate embodiment, the body of material completely fills the tumbler and the mixing occurs primarily within the interior of the body.

In another alternate embodiment the cover, which is preferably of conical shape, is fixed, that is, non-rotatable, and the lower cone is proportioned in accordance with the function to be performed. A tumbler may be used for handling a single particulate material, either heated or not, or a combination of particulate materials, respectively coarse and fine, having different inlet temperatures, so that the tumbler serves as a heat exchanger. In one embodiment the tumbler includes a fuel burner for heating a material contained therein.

23 Claims, 9 Drawing Figures

75
76
35
65
36
37
66
67
70
15
10
50a
50b
12
20
91
23
92
94a
94
90
95
96
43
81
82
93
80
84
44
45
41
40
DRIVE
42
60
24
25
21
DRIVE
22
30
83

FIG. 3
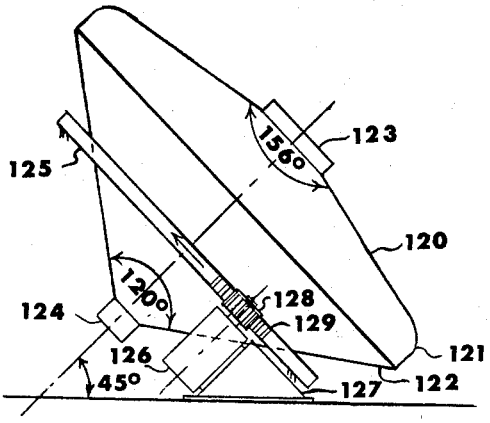
FIG. 2
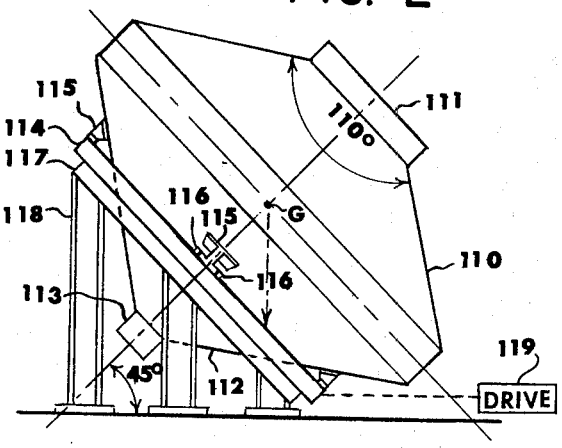
FIG. 6
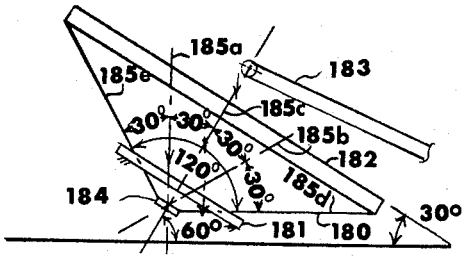
FIG. 4
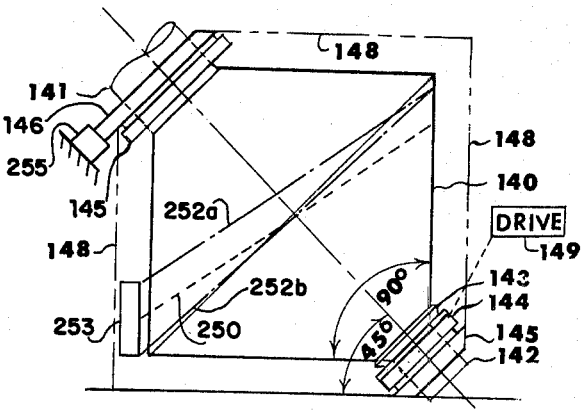
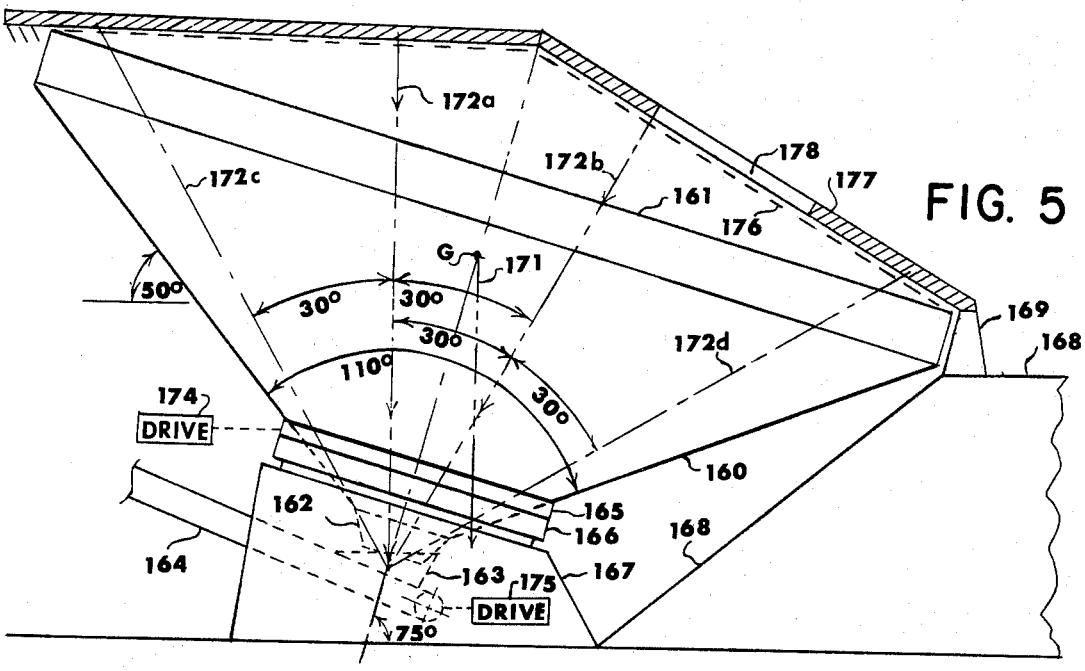
FIG. 5

INCLINED CONICAL ROTARY VESSELS FOR STORAGE AND TUMBLING OF MATERIALS TO ACCOMPLISH MIXING AND HEAT TRANSFER

This invention relates to improved rotary vessels and associated equipment for storing materials, for mixing materials, for heating materials and for transferring heat between two or more materials. The invention is particularly concerned with an improved process for transferring heat between briquettes and the raw materials from which they are formed, as in a hot briquetting process. The invention is also useful in the storage and mixing of raw materials for feeding to a process. The embodiments of the invention are particularly applicable to plants for hot briquetting of steel mill waste, such as mill scale, blast furnace dusts, steel-making furnace dusts, iron-bearing furnace slags, and water plant sludges and filter cakes.

Systems for storing, metering and mixing of materials usually are complicated and expensive, involving several pieces of equipment, such as conveyors, hoppers, feeders and mixers. When several materials are to be stored, metered and mixed, the system tends to be particularly elaborae. Also, most mixers are designed to operate batch-wise, rather than continuously, and have relatively low capacity.

Rotary kilns are commonly used for heating materials, and rotary drums have been used to mix two or more materials by tumbling them. In a specialized application, a rotary drum similar to a kiln has been employed to mix hot briquettes and damp raw materials so as to cool the briquettes and heat the raw materials, so that they are discharged at substantially the same temperature. These vessels have cylindrical walls that are rotated and end walls that usually are stationary and are so designed and operated that the solid materials fed thereto are moved from the elevated feed end toward the lower dischare end under the influence of gravity aided by the rotating motion of the vessel. Lifting blades are sometimes attached to the inner wall of the vessel by means of which the materials are lifted from the bottom to the top of the vessel and then cascaded back to the bottom in the course of the rotation.

Cylindrical drums and kilns have one or more of the following disadvantages in many processing applications: (1) They usually have a large length-to-diameter ratio and, therefore, occupy a large amount of space; (2) It is impracticable to operate them with a high percentage of the volume filled with material; (3) High gas velocities limit their capacities, because of excessive dust entrainment; and (4) They are difficult and expensive to seal at their ends, between the rotary portion of the vessel and the stationary closures.

It is an object of the present invention to provide a combinatin storage-mixing vessel that can operate continuously with a large holding capacity and that serves as an efficient mixer but which is nevertheless compact, simple in design, and inexpensive to construct, operate and maintain. It is a related object to provide a storage-mixing vessel that can be loaded batch-wise, and even intermittently, yet be operated continuously as a mixer and feeder.

It is another object of the present invention to provide a vessel for storage, mixing and heat transfer that is compact and efficient in the utilization of building space, supporting structures and foundations. It is a related object to provide a vessel in which a high percentage of its volume can be filled with materials to be stored, mixed, heated, or tumbled to transfer heat, particularly when combustible vapors or dusts are present. It is another related object to provide a vessel that can have a large diameter-to-length ratio, so that the gas velocities within the vessel will be low, so as to minimize dust entrainment when the vessel is used as a gas-to-solids heater or when large quantities of gases are evolved from the bed of materials. It is still another related object to provide a vessel that can operate as a solids-to-solids mixer and heat exchanger when substantially all of its volume is filled with solids.

It is another object to provide a vessel that is easy to seal at the two ends, employing openings which are relatively small and with the material discharge opening completely covered by the material being processed.

It is another object of the present invention to obtain a high efficiency of contact and mixing between coarse and fine solids, without reliance upon tumbling, by relative flow of the fine material by gravity to the discharge opening from a continuously changing portion of the bed as the vessel rotates. It is a related object to provide a design that takes advantage of the tendencies of fine and coarse materials to segregate and of fine particles to flow through the interstices between larger particles, so that the heat transfer capacity of the tumbler is greatly increased when employed to transfer heat between materials having substantially different size ranges, such as between particles that are to be hot briquetted and the hot briquettes into which they have been formed. In this case, the briquettes are retained in the tumbler for a much greater length of time than are the fines and, therefore, the tumbler normally contains a higher porportion of briquettes than of fines. Since more time is required to cool briquettes than to heat fines, because of the great difference in the sizes and heat contents of the two materials, the size of the vessel must be based on the retention time required for the briquettes; therefore, the vessel can be smaller as a result of this segregation.

It is another object of the invention to provide a vessel that has a particularly favorable shape for holding a heavy, concentrated load of materials and which permits support and rotation by economical means.

Other objects and advantages of the invention will become apparent upon reading of the attached detailed descriptions and upon reference to the drawings in which:

FIG. 2 shows a tumbler supported on a single bearing.

FIG. 3 shows a tumbler and its driving mechanism.

FIG. 4 illustrates a tumbler having two support bearings.

FIGS. 5 and 6 illustrate alternate designs of tumblers designed for storage, mixing and feeding of raw materials to a plant.

While the invention has been described in accordance with certain preferred embodiments, it will be understood that I do not intend to be limited to the particular embodiments but intend, on the contrary, to cover the various alternative and equivlaent forms of the invention included within the spirit and scope of the appended claims.

Figure 1:
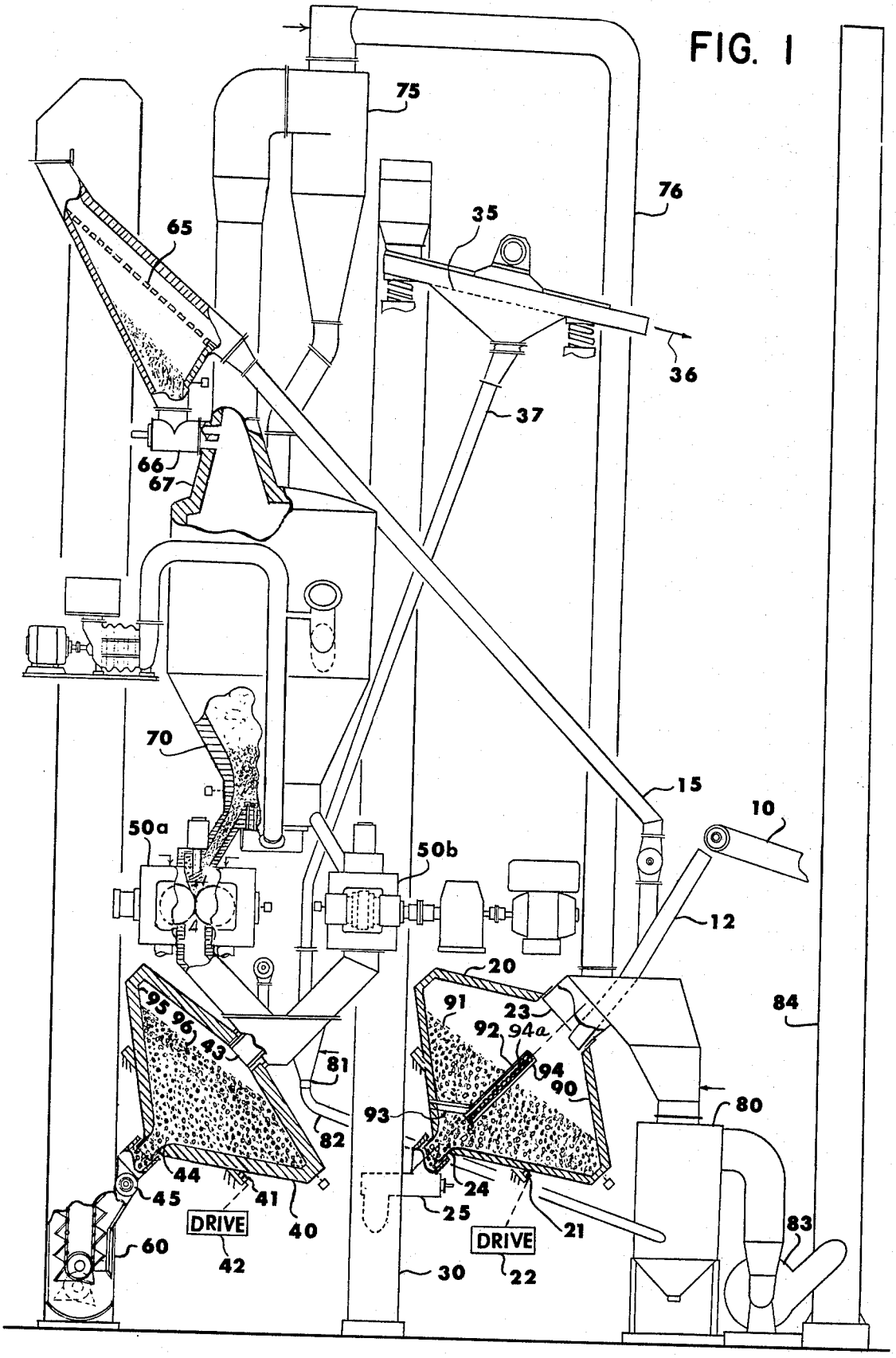
FIG. 1 is a schematic elevation view of a briquetting plant employing tumblers constructed in accordance with the invention, with the tumblers being shown in vertical section.

Turning now to FIG. 1 there is shown a hot briquetting plant, which is described in more detail in my copending application Ser. No. 788,639 filed Apr. 18, 1977, in which two tumblers that are embodiments of the present invention are illustrated. In this plant, feed from conveyor 10 and hot briquettes from chute 15 enter tumbler 20 through its inlet 23 by the way of chute 12. The tumbler is supported by a bearing 21 and rotated by a variable-speed drive 22.

In carrying out the present invention the conical tumbler is rotated at a slow speed lying within the range of a fraction of a revolution per minute (as for example 0.2 revolution) and several revolutions per minute. The two materials are mixed until approximately the same temperature and then discharged through its outlet 24 by feeder 25 and elevator 30 to screen 35. The briquettes 36 are discharged from the plant by the screen, and the feed material flows through chute 37 into the second tumbler 40 by way of its inlet 43, where it is mixed with hot briquettes from compactors 50*a* and 50*b*. This tumbler is supported by bearing 41 and driven by drive 42. The two materials are mixed in the tumbler until they reach substantially the same temperature and then are discharged through its outlet 44, feeder 45 and elevator 60 to screen 65. The briquettes are separated and fed through chute 15 to the first tumbler 20 and the fines are fed by feeder 66 into feed/gas heat exchanger 67 to furnace 70. The feed is heated in the furnace and discharged to the two compactors 50*a* and 50*b*. The furnace off gases pass through the feed/gas heat exchanger, then through cyclone 75 for removal of entrained solids and through duct 76 into scrubber 80. The gases from tumbler 20 also enter this scrubber. Off gases from tumbler 40 pass through scrubber 81 and a pipe 82 then into scrubber 80. All gases from scrubber 80 are exhausted by fan 83, which discharges to atmosphere by way of stack 84.

Turning attention more particularly to tumbler 20 the tumbler will be seen to have a refractory lining 90 for resisting and containing heat of the body of material and for protecting the tumbler body against abrasion as the tumbler rotates. Tumbler 20 serves as a dryer for the raw feed material; therefore, substantial quantities of steam are evolved from within the bed, as well as from its surface 91. The body of material maintained within the tumbler has a volume which is approximately equal to the volume of the lower cone so that the surface 91 of the bed is maintained near the mid-section of the vessel, so that the presented elliptical surface area is at its maximum and, as a result, the velocity of gases leaving the bed are minimal. This vessel also has a large freeboard volume to provide space for solids entrained in the gases to drop out and return to the bed.

A special gas collector 92 submerged within the bed, is also illustrated. This gas collector is in the form of a tube extending axially in the central portion of the lower cone from the region of the outlet, where it is supported by half-tube legs 93 which also serve as gas collectors. The pipe extends above the body of material, above which the collected gases are discharged through openings 94 into the freeboard area, thereby relieving gas pressure within the body. A chain 94*a* is suspended from the upper end of the tube and tumbles against the inner wall of the tube as the tumbler rotates, thereby breaking up any accumulated deposit of solid material within the tube to maintain a free and open passage for gas within the tube.

In the sectional view of tumbler 40, its insulating refractory liner 95 is illustrated. Tumbler 40 serves as a de-oiler of the feed material, from which small quantities of oil are vaporized within the vessel. The volume of off-gases is small, and an explosion hazard exists; therefore, the vessel is designed with a small freeboard area and operated so that the bed 96 fills 80–90 percent of the vessel under normal conditions. Since the oil vapors are generated near the surface of the bed, no internal gas collector is provided within the bed.

In tumblers 20 and 40 the mixtures of hot briquettes and cooler feed materials have substantial differences in size and, as a result, the relatively fine feed materials flow through the interstices between the larger briquettes, in the general direction of the outlet, as the tumblers slowly rotate, with the result that the average retention time of the coarse briquettes is greater than the average retention time of the finer feed thereby enabling the briquettes to achieve a temperature prior to discharge which is more nearly an equilibrium temperature.

FIG. 2 is an external elevation view of a tumbler similar in shape to tumbler 20 of FIG. 1. This tumbler has an upper cone section 110, having an opening 111, through which feed may be charged and gases exhausted, and a lower cone section 112 having an outlet 113 for discharging the material. The upper and lower cones have included angles of 110°, and the tumbler is inclined at a 45° angle. The tumbler is mounted ona single large diameter bearing 114, the bearing being located sufficiently high on the lower cone so that a vertical line through the center of gravity G passes within the confines of the bearing even when the tumbler is completely filled. The tumbler has multiple mounting supports 115 held in place by multiple stops 116 on the bearing ring, which allow for thermal expansion and contraction of the shell. Bearing 114 is supported by base 117 and supports 118. The arrangement of the drive 119 is similar to the one illustrated in FIG. 3.

FIG. 3 is an external view of a tumbler 120 similar to tumbler 40 of FIG. 1. The upper section, or cover, 121 is preferably a dished head of the type used as an end member of a pressure vessel or tank, and the lower section 122 is conical. An upper opening 123 is provided for feed entry and gas discharge, and a lower connection 124 is provided for feed discharge. The included angles are 110° for the lower cone and 156° for the upper cone. The tumbler is supported on an annular bearing 125 so that it is inclined at a 45° angle. This bearing consists of a rotatable ring secured to the lower cone and a fixed ring, the rotatable ring having gear teeth 129. The driving means, indicated at 126, includes a drive pinion 128 meshing with the gear teeth 129. The drive 126 is positioned on a support 127, and the tumbler is rotated in the direction shown so that the drive mechanism provides a lifting force as well as driving force.

FIG. 4 shows a tumbler 140, having two identical conical sections with included angles of 90°, and inclined at a 45° angle. This tumbler is supported by axially spaced annular bearings, the first bearing 144 coaxially surrounding the outlet 142 of the lower cone while the second bearing 146 coaxially surrounds the inlet 141. The bearing supports 145 and 147 are connected to structural steel supports 148, such as building columns and girders. The tumblers is rotated by a drive 149 connected to the lower bearing. The tumbler is loosely fitted into the bottom receptacle 143 and within the upper bearing 146, to allow for thermal expansion and contraction and a slightly eccentric motion of the shell. The drawing, FIG. 4, illustrates two methods for measuring bed level 150. In one method, a radioactive source 151 provides a beam or gamma rays having limits 152*a* and 152*b*, which are measured by receiver 153. In the sketch, the reading indicated by the receiver would be 50 percent, since the bed would prevent half of the rays from reaching the receiver. In the second method, the upper bearing support 147 is mounted in such a manner as to be free to tip bodily under the action of gravity, resting upon a load cell 155, which is calibrated to indicate the level 150 in the tumbler, based on the component of force applied to the cell. Both methods employ readily available measuring equipment and related instrumentation.

FIG. 5 is an elevational view of a large tumbler which is designed for storing and mixing several raw materials for feeding to a plant such as the one shown in FIG. 1. The tumbler may have a lower cone section 160, slowly, which has an included angle of 110°, and is inclined at an angle of 75°, the top 161 of the tumbler being open. The vessel has an outlet 162 that discharges into a hopper 163, which channels the discharge material onto a conveyor 164, which has a variable speed drive 175. The tumbler is mounted by its supporting ring 165 on annular bearing 166, which is fastened to foundation 167. The tumbler is rotated by a variable speed drive 174. A vertical line 171 from the center of gravity G of the completely loaded vessel passes well within the confines of the bearing and supporting structures. The tumbler is loaded by mobile equipment, such as a front-end loader, which is supported by ramp 168 and positioned by bumper 169. A dotted line 170 indicates the maximum loading of the tumbler, assuming for design purposes a 30° angles of repose of the material. A cover 177, having a feed opening 178 and supported independently of the tumbler may be optionally provided to confine any dust. The material discharges from the tumbler from a zone directly above the outlet 162 at the most rapid rate along vertical line 172*a* and at lesser rates at other points within the zone formed by lines 172*b* and 172*c*. As the tumbler rotates, the bed rotates with it, so that material fed into the zone between lines 172*b* and 172*d* is carried, during 180+ of rotation, into the zone between lines 172*b* and 172*c*, and material deposited near line 172*b* rotates to the vicinity of line 172*a*. Since the discharge zone changes, by precession, continuously as the vessel rotates, the discharged material represents a composite mixture of the materials fed to the tumbler. Material deposited in the annulus formed by the conical shell of the tumbler 160 and the cone transcribed by orbiting lines 172*c* and 172*d* around the axis does not move toward the outlet at a very rapid rate until the vessel is nearly empty.

FIG. 6 is a simplified view of an alternate arrangement of a tumbler similar to the one shown in FIG. 5 but designed to provide more complete mixing of the feed materials within the tumbler. The shell 180 of this tumbler has an included angle of 120° and an inclined angle of 60° and is mounted within bearing 181. A vertical line from the center of gravity falls well within the confines of the bearing. The top 182 of the tumbler may be open, or closed except for a feed opening (such as 178), for feeding by a conveyor 183. Since the top of the tumbler is sloped at a 30° angle, the maximum loading, with a material having an angle repose of 30°, would be along the top 182 of the vessel. The feed materials discharging through bottom opening 184 have a tendency to move vertically within the vessel along line 185*a* and in a conical pattern surrounding this line, extending approximately 30° in all directions from the line. Material fed into the zone surrounding line 185*b* reaches the zone surrounding line 185*a* after 180° of rotation, so that a feed zone defined by lines 185*c* and 185*d* becomes the discharge zone defined by lines 175*c* and 175*e*. Since the region of feed material available for discharge precesses continuously, this results in efficient mixing.

Tumblers of the designs shown in FIGS. 5 and 6 capable of holding several hundred tons of material may be readily constructed. Using such tumblers it is possible to discharge a reasonably uniform product, even though the tumblers might be charged with baches of material components of 5–10 tons, and even though as many as five or more different materials are charged. If desired, the vessel may be loaded, in many applications, with a 16-hour supply of material, thereby making it possible to perform all materials charging operations during the day shift.

Figure 7:
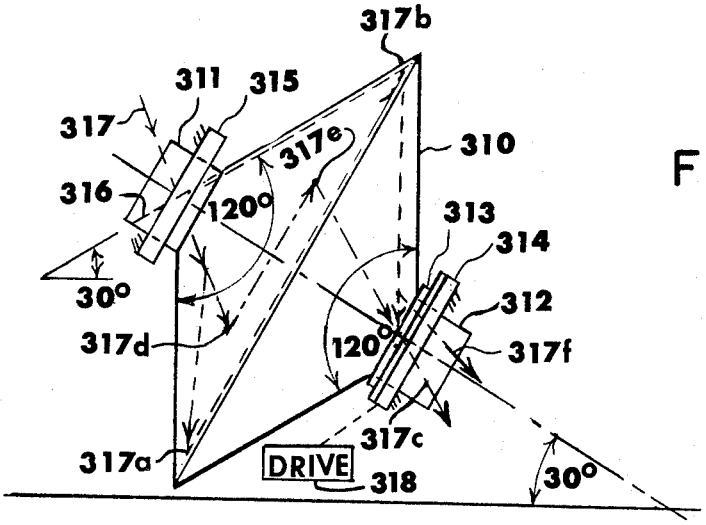
FIG. 7 illustrates flow patterns of materials within a tumbler.

FIG. 7 shows a tumbler 310 having included angles of 120° within the upper and lower cone sections. The vessel is inclined at a 30° angle. Feed 317 enters the upper nozzle 311, and any gases evolved exit through this connection. The feed exists through nozzle 312. The tumbler is seated in receptacle 313 fastened to a lower bearing 314 surrounding the lower nozzle and supporting the lower end of the vessel. The tumblers is rotated by a drive 318 connected to the lower bearing 314. Nozzle 311 at the top extends through bearing 315, which supports the upper end of the vessel. Dotted line 316, indicates that the vessel is capable of being totally filled by material having an angle of repose of 30°, even though portions of the vessel extend substantially above the inlet nozzle 311, since the material is carried to the upper reaches of the vessel during its rotation, without the use of flights. A substantial amount of mixing of free-flowing materials can occur in the tumbler, even though it may be kept essentially completely filled by an unlimited supply of feed 317 entering through the inlet 311, with the rate of throughput established by a discharge feeder (not shown) connected to the outlet 312. Continuus mixing of the body of materials within the tumbler can be accomplished as the individual particles traverse the body along a multiplicity of paths by intermittent movements at constantly changing rates and in constantly changing directions, all of which are generally from the inlet toward the outlet, as the paths precess orbitally through the mass by reason of the conical shape, inclined axis and rotation of the tumbler.

For example, indicated in FIG. 7 are three of the many possible flow paths that three individual particles might follow as the tumbler is completely filled while slowly rotated 180° and then stopped and emptied. The three paths shown are as follows: (1) Feed 317 enters inlet 311 and flows along the axis to outlet 312, where it is discharged; (2) feed 317 entering nozzle 311 traverses a path to point 317*a*, then is rotated during 180° of rotation while remaining in a fixed position within the bed to point 317*b*, and then follows the indicated path to point 317*c;* and (3) feed 317 enters through nozzle 311 to point 317*d,* is rotated without changing its position within the bed to point 317*e* and then flows along the indicated path to 317*c,* in which case, a particle from point 317*b* may be diverted from discharge point 317*c* to point 317*f.* Particles following the three paths tend to flow at different rates, with flow along the axis at the lowest rate but for the shortest distance and the flow from point 317*b* to point 317*c* of 317*f* at the highest rate but for the greatest distance. Thus, mixing occurs even during quite slow rotation of the tumbler. Also, since the tumbler will normally be rotated many times while a particle traverses the body of material, the particles will actually move toward the outlet in zig-zag paths, speeding up as they approach the zenith of their paths and slowing down and stopping as they rotate toward the nadir (except for any particles remaining precisely on the axis).

Figure 8:
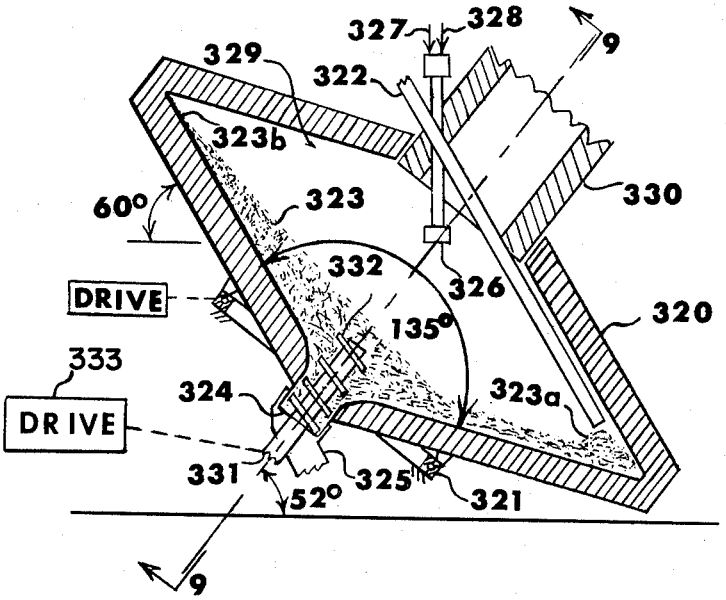
FIG. 8 is a cross sectional view of a tumbler employed for combustion or heating of materials, looking along line 8—8 in FIG. 9.

FIG. 8 shows another tumbler 320 in vertical cross section. This vessel is refractory lined, is designed to serve as a combustion chamber and is operated with a relatively small amount of material 323 therein. The vessel is supported by bearing 321 at an inclined angle of 52° and rotated by a drive connected to the bearing. The internal included angles, top and bottom, are 135°. The feed material, such as oily metal chips, is fed into the vessel through conduit 322 to replenish the bed at its lower periphery 323*a.* Material deposited at point 323*a* is carried to point 323*b* during 180° of rotation of the tumbler and gradually slides down a slope of up to 60° to outlet 324, during several rotations of the vessel, and into discharge chute 325, with the output controlled by an axially mounted discharge screw 331 having flights 332 and a variable speed drive 333. The screw extends upwardly through the discharge nozzle and into the bed to serve not only as a discharge feeder but also as an agitator within the bed to aid in withdrawal. Burner 326, supplied with fuel 327 and air 328, preheats the vessel and ignites the material. Combustion takes place within and near bed 323 and within the freeboard 329; and the gases generated are exhausted through duct 330 to gas treatment facilities (not shown).

Figure 9:
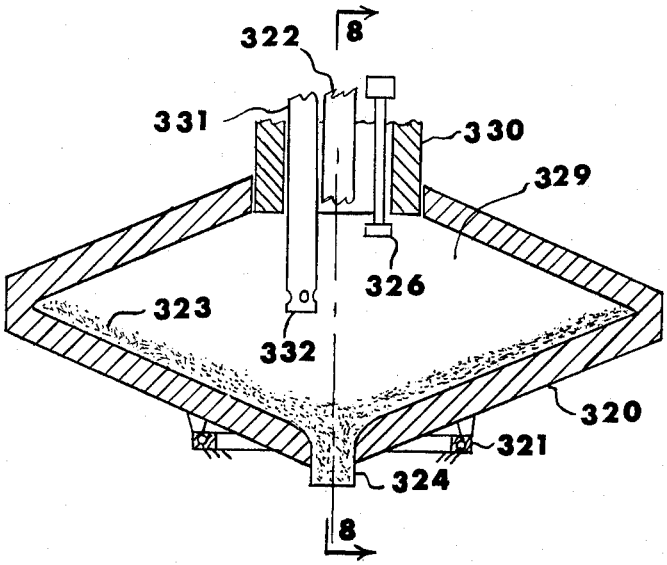
FIG. 9 is a section at right angles thereto, looking along line 9—9 in FIG. 8.

FIG. 9 is a cross sectional view based upon FIG. 8 but with the discharge screw and chute and the drives omitted. FIG. 9 shows the vessel 320 mounted on bearing 321, the feed supply conduit 322, the bed of material 323, the materials outlet 324, the burner 326, and the gas outlet 330. Also shown in this view is a combustion air supply pipe 331 and its distributor 332, which provide air as required for combustion within the bed 323 and freeboard 329 for temperature control of the vessel and the bed.

In a practical tumbler assembly it is desirable to have some controllable means for regulating the rate of discharge from the bottom outlet as, for example, a feeder of the screw type which may extend adjacent the outlet or which may project axially into the outlet, as disclosed. Also, a variety of other standard discharge regulating devices may be employed, including vibrating and oscillation conveyors, apron conveyors, belt conveyors, drag conveyors or self-feeding bucket elevators. However, it will be understood that the term "means for regulating the rate of discharge" need not be a controllable device, or even a mechanical device, and may simply be the diameter of the outlet port which is found to produce a desired rate of output under the force of gravity for a given material and rotative speed.

While the invention may be practiced in a conical tumbler having a lower included angle within the range of 80° to 135°, an optional cover with an upper included angle of 80° to 160°, an angle of inclination of 30° to 75°, speeds of rotation within the range of a fraction to several revolutions per minute, and a substantial range of practicable sizes and configurations, it will be understood that the selection of the included angles, inclination angle, rotational speed, size and configuration of the vessel for a particular application will depend upon a large number of factors that affect its practicability and the initial investment and subsequent operating costs, including ancillary equipment and structures, as follows:

With regard to the angle of inclination, if the vessel is to have an open top and be used for storage and mixing, the angle of inclination from the horizontal should benot less than 90° minus the angle of repose if the vessel is to be completely filled without overflowing. For example, if the material has a relatively common angle of repose of 35° (with respect to the horizontal) the material will overflow the vessel before it is filled if the angle of inclination is less than 55°. On the other hand, little or no refluxing or mixing of the material at the surface of the body of material will occur unless the angle of inclination is less than 90° minus the angle of repose. Enclosing the tumbler will allow it to be tilted at an angle conducive to good mixing at the surface while containing a body of material equal in volume to that of the lower cone, with the cover retaining the material so that it cannot overflow. Efficient mixing within the body of material can occur with free-flowing materials as the tumbler is fed, discharge and rotated continuously at an angle of inclination of up to 60° or more; however, this type of mixing is seriously impaired if the inclined angle is increased beyond 75°. When a tumbler is used as heat exchanger for hot briquettes and wet feed, it is desirable that a substantial amount of mixing take place at the surface by refluxing and cascading, in order to remove enough moisture from the feed so that it becomes free flowing before becoming embedded within the body of material, so that mixing may continue within the bed.

Turning next to the selection of inclined angle, with an open top conical tumbler, the included angle, as well as the angle of inclination, affects its holding capacity. Tumblers having included angles of less than 90° are not efficient users of building space and vessel construction material; however, if they are flared in excess of 110°, their internal holding capacity is decreased. Calculations show that, as the included angle of the cone is increased while the distance from the apex to the circumference of the base remains constant, the volume of the cone increases to its maximum at an angle of approximately 110° and then decreases thereafter. In cases where a high surface area for the body of material is desired and a high holding capacity is of little value, as may be the case for enclosed tumblers employed to heat material from above by a burner or to burn oil from metal chips, an included angle for the lower cone as great as 135° can be advantageous. If a large freeboard area is required, as for combustion or for gas-solids de-entrainment, a dome-shaped cover may be employed, instead of a conical cover, in order to obtain a greater volume. If, on the other hand, little or no gases are evolved or an explosion hazard exists, the cover may be relatively flat or else mostly filled with the body of material. If large quantities of gases are evolved from the bed, as in a briquette/feed tumbler used as a drier of fine feed material, it is best to have the volume of the body of material approximately equal to the volume of the lower cone, so that the velocity of the gases leaving the surface of the bed are low, and so that a relatively large freeboard volume is provided within the conical or dome-shaped cover for gas-solids disengagement.

As to the speed of rotation, if the tumbler is large and carries a heavy load, as in a storage-mixing vessel in which the residence time is relatively great, it is desirable to rotate the vessel at a relaively low speed. Also, if the tumbler is to be used as a briquette-feed heat exchanger that requires a substantial length of time and good mixing for the heat to be recovered from the briquettes, and unnecesary mechanical damage to the briquettes must be avoided, these objectives might be accomplished by making the vessel relatively large and rotating it at a relatively slow rate and at an angle of repose that would not cause excessive tumbling at the surface of the bed. In cases where the tumbler is to be used merelly as a continuous mixer of two or more materials but not as a storage or heat transfer vessel, a very high rate of rotation might be justified in order that the vessel might be small and yet accomplish adequate mixing at high throughput. The tumbler illustrated in FIG. 7, with the body of material occupying a high percentage of the volume of the vesse, might be employed for this type of application to mix the material as it cascades on the surface and as it traverses the bed along multiple, irregular paths as previously described.

One of the advantages of the inherently compact design of the tumblers of this invention is that the holding and throughput capacities are high, in comparison with vessels of different design having similar volumes and tare weights. Also, the apacity of the conical tumbler increases by the cube of the dimension; for example, if all dimensions are doubled, the holding capacity is increased by a actor of eight. In selecting the proper size and shape of tumbler for any given application, the factors summarized in the preceding paragraphs need to be considered and, also, the cost of fabricating the tumbler itself and its effect on the cost of building space, supporting structures, including the bearings, trunions, or rollers, arrangement of appurtenances needed for loading, driving and discharging, and accessibility for maintenance. As an example of factors to be considered in selecting the proper size, shape and arrangement of tumblers, a comparison of the tumblers shown in FIGS. 5 and 6 is pertintnt. For illustrative purposes, FIG. 5 shows a tumbler and a ramp for loading the tumbler by a front-end loader and FIG. 6 shows a belt conveyor for loading the tumbler illustrated; however, the tumbler of FIG. 6, being inclined so that it could be loaded from a ramp of lesser height and at a point nearer the edge of the vessel, is more practicable for the front-end loader, and the design of FIG. 5 would be more advantageous for belt loading through an opening in the cover at the apex of the body of material extending above the top of the tumbler. Also, in comparing the capacities of the two tumblers illustrated in FIGS. 5 and 6, assuming that they have equal diameters and that the angle of repose of the body of material is 30+, the tumbler of FIG. 5 may be loaded with approximatelly 50% more material than the one shown in FIG. 6, with approximately 69% of the increase being attributable to the body of material extending above the top of the vessle. The freeboard capacity of the vessel of FIG. 6 may be incrased to equal that of the tumbler of FIG. 5, by increasing its angle of repose from 60° to 75°; however, if this is done the body of the vessel would still have less volume, because its included angle of 120° is greater than the 110° included angle of the FIG. 5 tumbler.

While it is preferred to employ a tumbler in which the lower portion thereeof is cone-shaped in accordance with the normal dictionary definition of that term, it will be understood that the invention is not strictly limited thereto and that the term includes cone-like shapes including such variations as a profile which is slightly concave or slightly convex, for example, when make up frusto conical sections of differing included angle join acially end to end; thus references herein to included angle refer to the average included angle. The term conical also includes structures in which the axial cross section departs from a true circle, for example, a cross section made up of a series of interconnected chords resulting in a faceted outer surface.

What I claim is:

1. In a tumbler assembly for mixing, storing and feeding particulate materials and for transferring heat between different materials, the combination comprising a tumbler having a lower portion in the form of a hollow inverter lower cone enclosed by a circular cover, the cover having an axial inlet and the cone having an axial outlet, means for orienting the tumbler with its axis inclined at an angle of 30° to 75° with respect to the horizontal, the included angle of the cone lying within the range of 80° to 135°, means for supporting the tumbler for rotation about its axis, driving means for rotating the tumbler at a speed lying within the range of a fraction of a revolution per minute up to several revolutions per minute, and means at the outlet for controlling the rate of flow so that a body of material is maintained in the tumbler with mixing thereof by cascading of material added at the inlet across the surface of the body and with the body of materials being continually mixed as the individual particles traverse the body along a multiplicity of paths by intermittent movements at constantly changing rates and in constantly changing directions, generally from the inlet toward the outlet, as the paths precess orbitally through the mass by reason of the conical shape, inclined axis and rotation of the tumbler.

2. The combination as claimed in claim 1 in which the cover is in the form of an upper cone joined to the lower cone edge to edge.

3. The combination as claimed in claim 2 in which the upper cone has an included angle lying between 80° and 160°.

4. The combination as claimed in claim 1 in which the cover is of dome shape, presenting an edge which bears a shallow angle to the axis and which is mated to the edge of the lower cone.

5. The combination as claimed in claim 1 in which the body of material within the tumbler assembly is made up of a coarse component at one temperature and a fine component at a different temperature with heat exchange taking place between the two components and with the fine component flowing progressively downward toward the outlet through the interstices between the coarse component facilitated by the slow rotation with the result that the average retention time of the coarse component is greater than the average retention time of the fine component thereby enabling the coarse component to achieve a temperature prior to discharge which is more nearly an equilibrium temperature.

6. The combination as claimed in claim 1 in which the body of material maintained with the tumbler has a volume which is approximately equal to the volume of the lower cone.

7. The combination as claimed in claim 1 in which the body of material contains oil and in which the body of material is at a temperature above the vaporization temperature of the oil, the body of material occupying approximately 80–90 percent of the total volume of the tumbler while keeping the inlet free so that the free volume above the body of material is limited thereby tending to minimize the explosion hazard from the vaporized oil.

8. The combination as claimed in claim 1 in which the body of material is at an elevated temperature and of such composition that off gas is generated within the body, and means including a tube extending axially in the central portion of the cone from the region of the outlet to a point above the body of material and open at its opposite ends for conducting off gas from the body thereby to relieve gas pressure within the body.

9. The combination as claimed in claim 1 in which the body of material within the tumbler is at a high temperature and in which the composition of the body of material is such as to produce off gas at such temperature, the tumbler having at least one tube mounted therein which extends from a point within the body of material to a point above the body of material thereby to relieve any tendency toward pressure build-up of off gas within the body.

10. The combination as claimed in claim 9 in which the tube has suspended from the upper end thereof a chain which tumbles against the inner wall of the tube as the tumbler rotates thereby to constantly break up any accumulated deposit of solid material within the tube to maintain a free and open passage for gas within the tube.

11. The combination as claimed in claim 1 in which the tumbler includes a fuel burner positioned above the body of material for heating the same.

12. The combination as claimed in claim 11 in which the fuel burner is stationary and projects through the inlet of the tumbler.

13. The combination as claimed in claim 1 in which the body of material within the tumbler is at a high temperature and in which the tumbler has a refractory lining for resisting and containing the heat of the material and for protecting the tumbler against abrasion as the tumbler rotates.

14. The combination as claimed in claim 1 in which thetumbler has a single large diameter annular bearing for supporting the same, the bearing being positioned under the lower cone and in a plane normal to the axis of the tumbler, the bearing being located sufficiently high on the lower cone so that a vertical line through the center of gravity of the loaded tumber passes within the confines of the bearing.

15. The combination as claimed in claim 14 in which the annular bearing consists of a rotatable ring secured to the lower cone and a fixed ring, the rotatable ring having gear teeth and the driving means including a drive pinion meshing with the gear teeth.

16.The combination as claimed in claim 1 in which the tumbler is supported by two axially spaced bearings, the first bearing being of annular shape coaxially surrounding the outlet of the lower cone and the second bearing being of annular shape coaxially surrounding the inlet in the cover, the bearings being supported in such a way as to accommodate axial expansion and contraction of the tumbler.

17. The combination as claimed in claim 1 in which the means at the outlet for controlling the rate of flow is in the form of an axially extending screw conveyor penetrating the outlet.

18. The combination as claimed 1 in which the means at the outlet for controlling the rate of flow is in the form of a screw conveyor, driving means for the screw conveyor, and means for variably controlling the speed of the driving means.

19. In a tumbler assembly for mixing, storing and feeding particulate materials, the combination comprising a tumbler in the form of a hollow inverted lower cone, means for orienting the tumbler with its axis inclined at an angle of 30° to 75° with respect to the horizontal, the included angle of the cone lying within the range of 80° to 135°, means for supporting the tumbler for rotation about its axis, driving means for rotating the tumbler at a speed lying within the range of a fraction of a revolution per minute up to several revolutions per minute, means at the outlet for controlling the rate of flow so that a body of material is maintained in the tumbler with mixing thereof by cascading of material across the surface of the body and with the body of materials being continually mixed as the individual particles traverse the body along a miultiplicity of paths by intermittent movements at constantly changing rates and in constantly changing directions, generally from the inlet toward the outlet, as the paths precess orbitally through the mass by reason of the conical shape, inclined axis and rotation of the tumbler.

20. The combination as claimed in claim 19 including a circular cover having edges mating with the edges of the lower cone to serve as a collecting hood for any gas or dust emanating from the body of material, the cover being fixedly mounted and therefore non-rotatable with the lower cone, the cover having an opening to permit recharging of material within the lower cone.

21. The combination as claimed in claim 19 in which the cone is supported upon a single large diameter bearing of annular shape lying in a plane which is normal to the axis of the tumbler and which is comprised of a rotatable ring secured to the underside of the cone and a fixed ring for supporting the same, the bearing being of sufficiently large diameter and positioned high enough on the cone so that a vertical line extending through the center of gravity of the loaded tumbler passes within the confines of the bearing.

22. The combination as claimed in claim 19 in which the body of material stored and mixed by the tumbler is at least as great as the volume of the tumbler.

23. In a tumbler assembly for mixing, storing and feeding particulate materials and for transferring heat between different materials, the combination comprising a tumbler having a lower portion in the form of a hollow inverted lower cone enclosed by a circular cover, the cover having an axial inlet and the cone having an axial outlet, means for orienting the tumbler with its axis inclined at an angle of 30° to 75° with respect to the horizontal, the included angle of the cone lying within the range of 80° to 135°, means for supporting the tumbler for rotation about its axis, driving means for rotating the tumbler at a speed lying within the range of a fraction of a revolution per minute up to several revolutions per minute, means at the inlet for feeding the tumbler in such manner that it is kept substantially completely filled with a body of material and means at the outlet for controlling the rate of discharge so that the materials are retained in the tumbler for a selected length of time, with the body of materials being continually mixed as the individual particles traverse the body along a multiplicity of paths by intermittent movements at constantly changing rates and in constantly changing directions, generally from the inlet toward the outlet, as the paths precess orbitally through the mass by reason of the conical shape, inclined axis and rotation of the tumbler.

* * * * *